United States Patent [19]

Stoll, III

[11] 4,114,779

[45] Sep. 19, 1978

[54] BUNG HOLE ASSEMBLY

[75] Inventor: Andrew Joseph Stoll, III, Toledo, Ohio

[73] Assignee: Owens-Illinois, Inc., Toledo, Ohio

[21] Appl. No.: 767,596

[22] Filed: Feb. 10, 1977

[51] Int. Cl.[2] ..... B65D 41/04; B65D 51/18; B65D 39/00

[52] U.S. Cl. ..... 220/288; 220/254; 220/307; 220/323; 220/72

[58] Field of Search ..... 220/288, 254, 306, 307, 220/315, 323, 66, 72, 85 F, 289; 285/201, 202, 203

[56] References Cited

U.S. PATENT DOCUMENTS

| | | | |
|---|---|---|---|
| 1,986,061 | 1/1935 | Hill | 220/288 |
| 2,811,768 | 11/1957 | Axelson | 220/306 X |
| 2,962,185 | 11/1960 | Starr et al. | 220/39 |
| 3,173,569 | 3/1965 | Craig | 220/39 |
| 3,432,069 | 3/1969 | Craig | 220/63 |
| 3,647,110 | 3/1972 | Hammes | 220/72 |
| 3,815,776 | 6/1974 | McMillan | 220/288 X |
| 3,889,839 | 6/1975 | Simon et al. | 220/72 |
| 3,986,634 | 10/1976 | Smith et al. | 220/288 |

*Primary Examiner*—William Price
*Assistant Examiner*—Steven M. Pollard
*Attorney, Agent, or Firm*—Charles S. Lynch; E. J. Holler

[57] ABSTRACT

An improved closure assembly for plastic drums is provided which includes female buttress threads formed on a tubular projection of the drum head, and an adaptor inserted into the tubular projection threadably engaging the buttress threads, the adaptor having internal standard pipe threads adapted to receive standard pipe threaded members, like dispensing valves, pump fittings, as well as standard bung plugs. Means are also provided for sealingly isolating the buttress thread inter-engagement to prevent product accumulation therebetween and means are also provided for locking engagement of the adaptor and the tubular projection on the drum.

12 Claims, 10 Drawing Figures

BUNG HOLE ASSEMBLY

THE INVENTION

The present invention is directed to plastic drums and more particularly to bung hole closure assemblies for plastic drums. Steel drums have been employed for extensive periods of time, in the art of handling bulk quantities of materials, for example, materials, and especially liquids, on the order of 30 gallons, and up. Because of this long and wide spread usage of steel drums, equipment has been developed which is geared to handling such steel drums. This equipment, for example, includes drum dispensing and filling devices such as, for example, valves, pumps, and various fittings. All of such standard dispensing and filling devices now employed have a standard pipe thread on them, typically an American standard taper pipe thread (NPT).

More recently there has come onto the market plastic drums made from thermoplastic materials such as, for example, polyethylene, which drums have many and numerous advantages over steel drums. Unfortunately, however, these drums have not yet received their full potential because the ultimate users of these drums require them to be generally interchangeable with equipment used for filling and dispensing materials to and from steel drums. One type of plastic drum which has many desirable and needed characteristics is a tighthead drum which has been molded, for example by blow molding, as a single piece article, which drum is typically made of high density polyethylene. In blow molding such a drum, difficulties are encountered, if the internal female thread-form used for the collar, which defines the bung hole opening, is made with either tapered or straight pipe thread. First of all, because of the blow moldable nature of the material employed, for example polyethylene, when such standard pipe threads are formed, difficulty results in screwing in bung plugs, or other dispensing or filling devices, which have a standard screw thread and cross threading can result because of their fine thread form. Such cross threading causes permanent damage to the drum and creates product leakage problems; thus, plastic drums with such pipe threads have not been fully accepted. Another problem which results in forming female standard pipe threads, for example tapered pipe threads, on the bung hole defining collar is that in the blow molding operation a problem with ovality results as well as other bung hole warpage; because of the general oval configuration and warpage of the female blow molded pipe thread, such threads exhibit a strong tendency to expel plugs, and other devices, having standard pipe threads thereon during impact tests.

The collar member generally defining the opening into the drum, commonly referred to as the bung hole, has been provided with female buttress threads but this approach has been generally rejected by ultimate users of such drums, because the standard filling and dispensing devices cannot be used with such buttress threads. An example of the use of a female buttress thread is set forth in U.S. Pat. No. 3,647,110, and in corresponding German Patentschrift No. 1 920 515, showing a female buttress thread and a seal beneath the thread. Such an arrangement has not been acceptable because standard dispensing and filling devices which, as indicated above, contain standard pipe threads are not of immediate direct utility with that configuration. Additionally, bearing in mind that a buttress female thread formation is not a standard pipe thread, the inadvertent loss, or misplacement, of the complimenting bung plug renders the drum virtually useless to the ultimate user.

Adaptors have been employed along with bung assemblies having internal female buttress threads such as, for example, as indicated in U.S. Pat. No. 2,962,185. This type of approach however is unsatisfactory in that, again, loss of the adaptor results in rendering the drum useless to the ultimate drum user. Similarly, product can leak into the buttress thread inter-engaging areas and be retained therein. This is undesirable in that it presents a possible problem with contamination, as when it is desired to alternate products in the drum. Such leakage, and product accumulation in those areas, may also cause the adaptor to be permanently locked into the drum; should any damage be done to the adaptor, as in cross threading standard fittings to the adaptor, the entire drum may have to be discarded.

Approaches have also been attempted wherein prefabricated injection molded inserts are formed into the drum by inserting them in the mold during the blow molding operation. This approach likewise is not entirely satisfactory because, for example, this increases the fabrication cost of the drum and problems also exist in that the desired seal between the insert and the material being blow molded may not be obtained. One such approach is illustrated in U.S. Pat. No. 3,889,839 which employs an adaptor having outer buttress threads and inner pipe threads. Such an approach is subject to the same deficiencies mentioned above regarding product leakage and loss of the adaptor will render the drum incapable of direct attachment to standard pipe fittings.

Exemplary of other plug and closure devices are those set forth in U.S. Pat. Nos. 2,906,429, 3,432,069, and 3,173,569.

In British patent specification No. 1,383,500 there is disclosed a coupling member for use with drums which member is snappingly positioned over the drum collar and is adapted to receive a bung closure. Keyways are provided for preventing rotation of the coupling member relative to collar. There is, however, no recognition of the present inventive concept therein.

Thus, as will be seen from the foregoing problems exist in the art and a need exist in the art for providing a suitable bung hole closure assembly for a plastic drum and especially a single piece blow molded plastic drum such as, for example, a tight-head plastic drum made from high density polyethylene. It is an object of this invention to satisfy these needs in the art and to solve the problems by providing for an improved bung hole closure assembly.

Thus, in accordance with this invention a bung hole closure assembly for a plastic drum is provided, the closure assembly including an upwardly extending tubular projection on the drum which projection includes internal female buttress threads and has an annular internal sealing surface formed below the threads such that upon sealing thereof the buttress threads are isolated from contact with the product. A tubular member, or adapter, or bushing, is then inserted into the tubular projection with the adapter, or bushing, having external buttress threads adapted to threadably engage the internal buttress threads of the tubular projection; the adaptor or bushing further includes internal standard pipe threads, e.g. tapered pipe threads, and annular sealing means carried by the adaptor or bushing for sealingly engaging the sealing surface of the tubular projection so as to isolate the buttress threads from product contact.

Releasable inter-engaging means, respectively disposed externally on the adaptor or bushing and internally on the tubular projection, are provided for locking the adaptor in one direction of rotation but allowing a slipping engagement when the adaptor is rotated in another direction. These inter-engaging means thus allow the adaptor to be sealingly and tightly inserted into the tubular member by the slipping engagement but precludes inadvertent removal of the adaptor or bushing by the locking engagement. The interengaging means are so arranged and constructed such that the locking inter-engagement can be affirmatively released when desired to allow removal of the bushing or adaptor. Means are also provided which are brought into threaded inserted engagement with the internal standard pipe threads of the adaptor to sealingly close the bung hole opening in the drum.

The advantages and improvements of the present invention will be more readily apparent by reference to the attached drawings of which:

Figure 1:
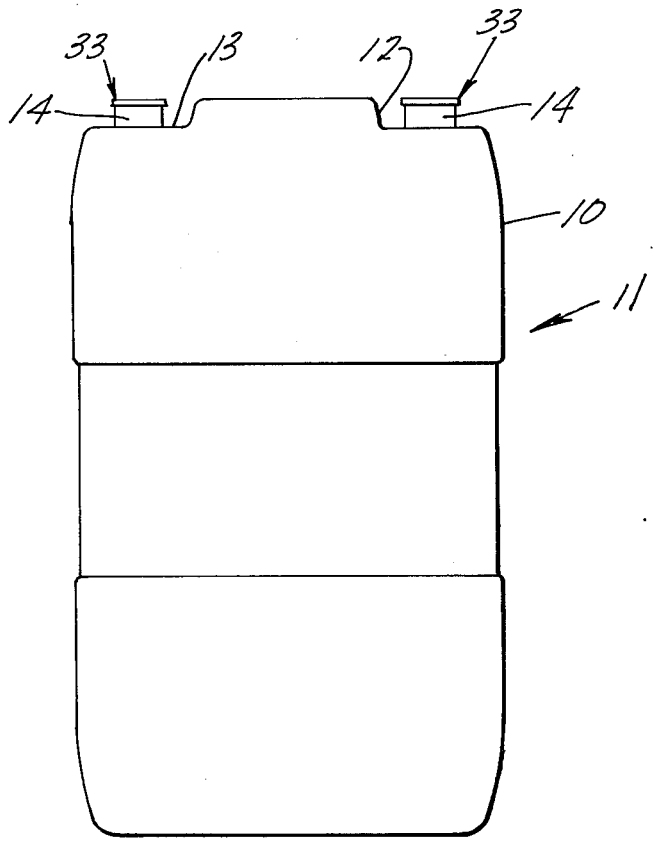
FIG. 1 is a front elevation view of a drum having tubular projections thereon which are closed and sealed in accordance with this invention.
Figure 2:
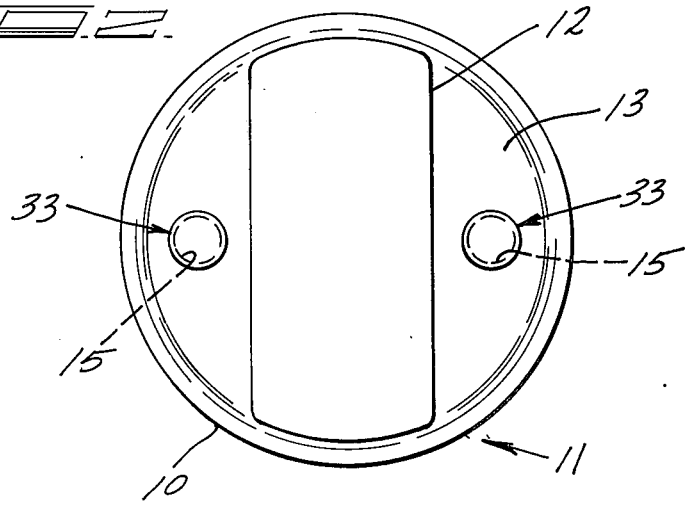
FIG. 2 is a top view of the drum of FIG. 1.
Figure 6:
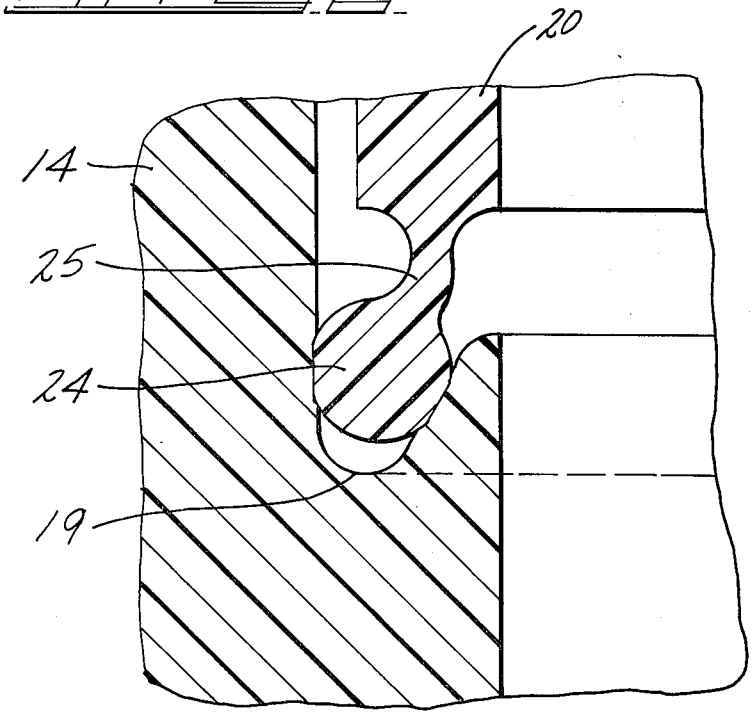
FIGS. 6–10 are sectional views illustrating alternate embodiments for sealingly isolating the buttress thread engagement.

In FIG. 1 there is generally illustrated a thermoplastic drum which has been molded as a single piece article by a blow molding operation, which drum includes a sidewall 10 unitarily merging with the top and bottom walls of the drum, generally represented as 11. The top wall includes a raised panel portion 12 which merges with opposite recessed portions 13. Each portion 13 is formed with an upwardly extending tubular projection 14 which serves to define a bung hole opening 15 in the drum. Tubular projection 14 includes an upper annular portion which tapers upwardly and outwardly to define a shoulder 16 which shoulder includes a substantially flat upper surface. Disposed internally, and in an upper portion of tubular projection 14 and generally in an internal circumferential path are a series of ratchets 17. Beneath ratchets 17, and also unitarily formed internally on tubular projection 14, are downwardly spiralling female buttress threads 18. Beneath buttress threads 18, so adapted and arranged that upon sealing thereof the buttress threads will be isolated from the contents in the drum, is an annular internal sealing surface. As exemplified in FIGS. 3 and 6 this sealing surface is in the form of an upwardly opening reentrant portion, or recess, 19.

Figure 3:
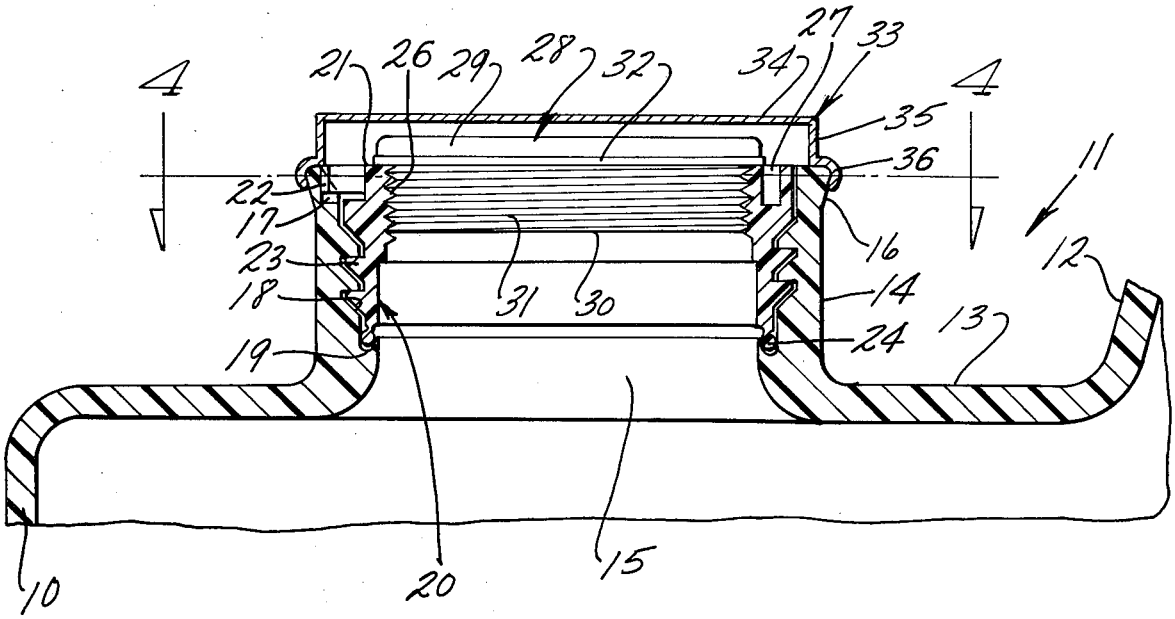
FIG. 3 is a general sectional view through one of the tubular projections illustrating an embodiment of this invention.
Figure 4:
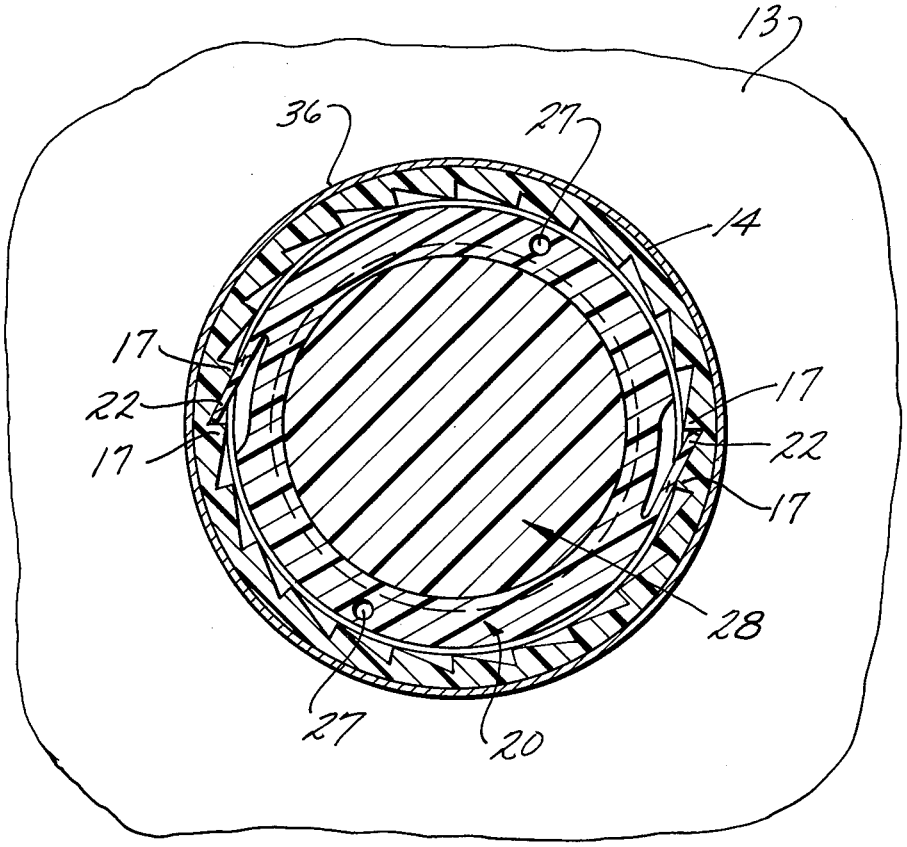
FIG. 4 is a view taken along plane 4—4 of FIG. 3.
Figure 5:
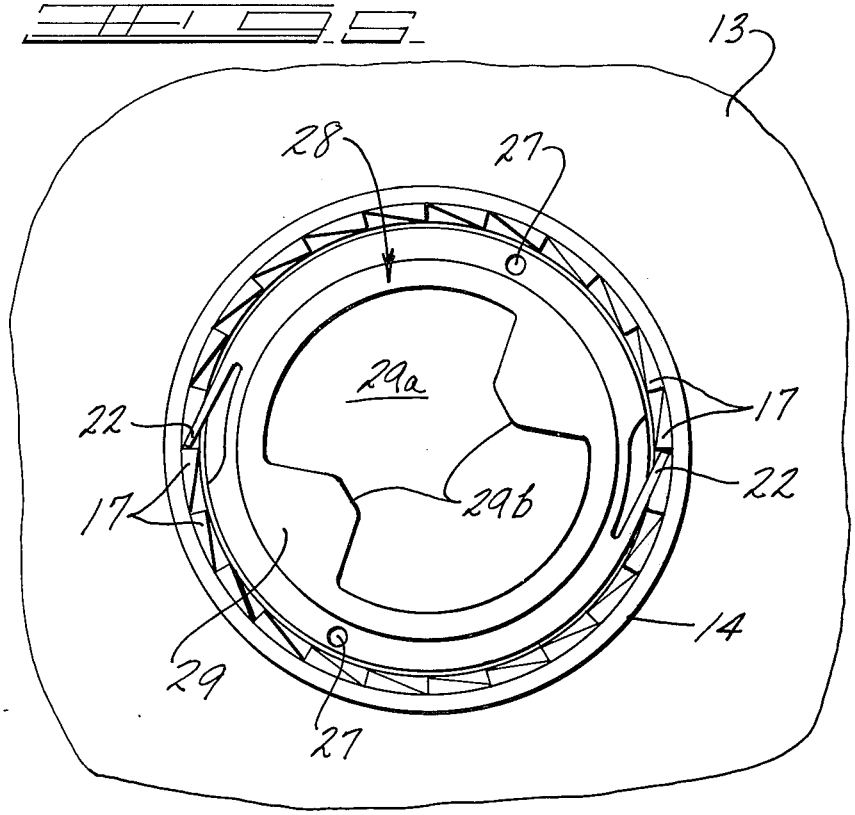
FIG. 5 is a plan view illustrating the interengaging means of the adaptor and tubular projection.

Inserted within tubular projection 14 is an annular plastic bushing, or adapter, 20. Bushing 20 includes a generally flat upper sealing surface 21 and integral with bushing 20 at an upper portion thereof beneath sealing surface 21 are externally disposed pawl members 22 which are pivotal inwardly and outwardly and are generally biased outwardly. Ratchets 17 and pawls 22 are arranged and constructed for slipping engagement in the direction of tightening rotation of bushing 20 and for locking engagement in the direction of rotation which threadably releases bushing 20 from tubular projection 14. Pawls 22 are illustrated as being two diametrically opposed pawls, although it will be apparent that other numbers could likewise be employed. The external surface of bushing 20, beneath pawls 22, is provided with complementary male buttress threads 23 adapted to threadably engage female buttress threads 18. At the lower margin of bushing 20 there is carried annular sealing means for sealingly engaging a sealing surface of tubular projection 14. As generally seen in FIG. 3 but more clearly shown in FIG. 6, the sealing means includes a bead-like sealing member 24 which is joined to the main body of bushing 20 in a single piece fashion by a thin flexible bridge portion 25. Generally, in order to provide the flexibility to insure the inter-engagement of bead-like sealing member 24 with reentrant portion 19, bridge portion 25 will be thin relative to the thickness of the main body of bushing 20. Generally, a thickness of bridge 25 on the order of about 1/32 inch will be found to be satisfactory for this purpose. Disposed internally on bushing 20 are a series of standard pipe threads 26. Generally, it will be observed that the crests and roots of the buttress threads are large relative to the standard pipe threads.

Pawls 22 of bushing 20 and ratchets 17 of tubular projection 14 are so arranged and constructed such that upon insertion of bushing 20 into tubular projection 14 and upon threadable engagement of male buttress threads 23 and female buttress threads 18 in a tightening direction, to the point where pawls 22 and ratchets 17 are brought into generally the same horizontal plane and interengage, pawls 22 slippingly engage ratchets 17 while the bushing is securely tightened; when bushing 20 is rotated in the opposite direction, such as to remove it from tubular projection 14, pawls 22 and ratchets 17 cause a locking engagement. It will also be observed that normally outwardly biased pawls 22, while disposed beneath the upper surfaces of tubular projection 14 and bushing 20, when the latter two are in tight threaded engagement, are so arranged and constructed such that they can be contacted, when desired, to release their locking engagement. Thus, as indicated previously, while the ratchet and pawls are adapted for slipping engagement when bushing 20 is being rotated so as to tightly attach it into the tubular projection 14, and are adapted for locking engagement in the direction of rotation of bushing 20 which would cause a removal of the bushing, pawls 22 can be deliberately and intentionally released by holding them inwardly when it is desired to provide for removal of bushing 20. Additionally if desired bushing 20 may be provided with a plurality of recesses 27 adapted to receive a spanner for allowing convenient tightening of bushing 20.

Thus as will be readily apparent from the foregoing bushing 20 is inserted within tubular projection 14 with threadable inter-engagement taking place between female buttress threads 18 and male buttress threads 23. A spanner is preferably employed to bring about a tightening relationship by being positioned in the spanner recesses 27. The bushing is then tightened and, as it approaches its final tightened position, bead-like sealing member 24 is forced into sealing engagement with the upwardly opening reentrant portion 19 to sealingly isolate the buttress thread formation from the contents of the drum. As the tightening of bushing 20 in tubular projection 14 approaches its ultimate tightened relationship, pawls 22 slippingly engage over ratchets 17 in the direction of rotation of bushing 20. When tightened to the degree desired the bushing, while being affirmative releasable from the tubular projection, is locked in position by the locking action of pawls 22 and ratchets 17. When it is affirmatively desired to selectively release bushing 20 from its engagement within tubular projection 14 the pawls can be simply pushed inwardly and the locking engagement thereby obviated. Thus it will be seen that the buttress thread formation is protected from the accumulation of any products in the drum by the sealing engagement of the respective sealing surfaces of the tubular projection 14 and bushing 20 and likewise inadvertent accidental loss or removal of bushing 20 is precluded by the inter-engaging pawl and ratchet features. Should damage result to bushing 20 there is no need to discard the entire drum as the bushing can be released and removed and a new bushing used.

Inserted within bushing 20 is a plug generally designated 28. Plug 28 includes a top panel 29 and a downwardly extending stem portion 30 which includes outwardly disposed standard male pipe threads 31, for example straight pipe threads which are threadably engagable with internal threads 26 on bushing 20. If desired panel 29 can include a suitable configuration to facilitate gripping for purposes of loosening and tightening plug 28 as, for example, a recessed portion **29*a* having generally radially disposed axially elongate grip facilitating walls 29*b*. Additionally plug 28 carries with it a sealing member 32 beneath panel 29 which is brought into tight sealing engagement with sealing surface 21 thereby closing opening 15 of the drum. Supplementary closure means for sealingly closing opening 15 is represented by use of an overcap generally designated 33 which is disposed outwardly of plug 29 and spans the uppermost margin of tubular projection 14. Overcap 33 includes a top panel 34 which circumferentially merges with a wall 35. Wall 35 carries an annular sealing portion 36 adapted to be brought into circumferential attached sealing relationship with shoulder 16**. Such sealing relationship may, for example, be brought about by a simple snapping action or by appropriate crimping. The overcap not only functions as a supplementary sealing means but also functions as a dust cover and serves as a temperproof seal.

Referring to FIGS. 7–10 there are generally illustrated alternate embodiments of the annular internal sealing surface of tubular projection 14 and the annular sealing means, carried by bushing 20. These fragmentary views generally show the relationship of the tubular projection 14 and the bushing 20 at a location beneath the threaded interengagement provided by the buttress threads.

Figure 7:
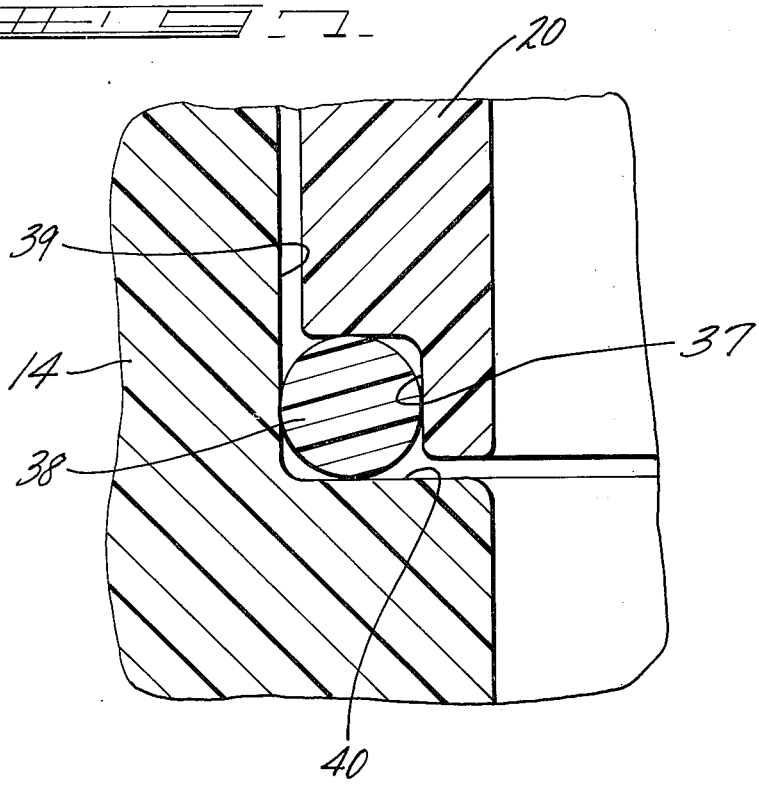

Referring now to FIG. 7 it will be seen that bushing 20 at its lower margin is provided with an annular slotted surface 37 adapted to carry an O-ring type sealing gasket 38. Tubular projection 14 includes a lower generally vertical wall portion 39 which merges with an inwardly disposed shoulder 40 whereby upon tightened insertion of bushing 20 into tubular projection 14, O-ring 38 establishes a seal between bushing 20 and tubular projection 14 to isolate the buttress threads from any product in the drum.

Figure 8:
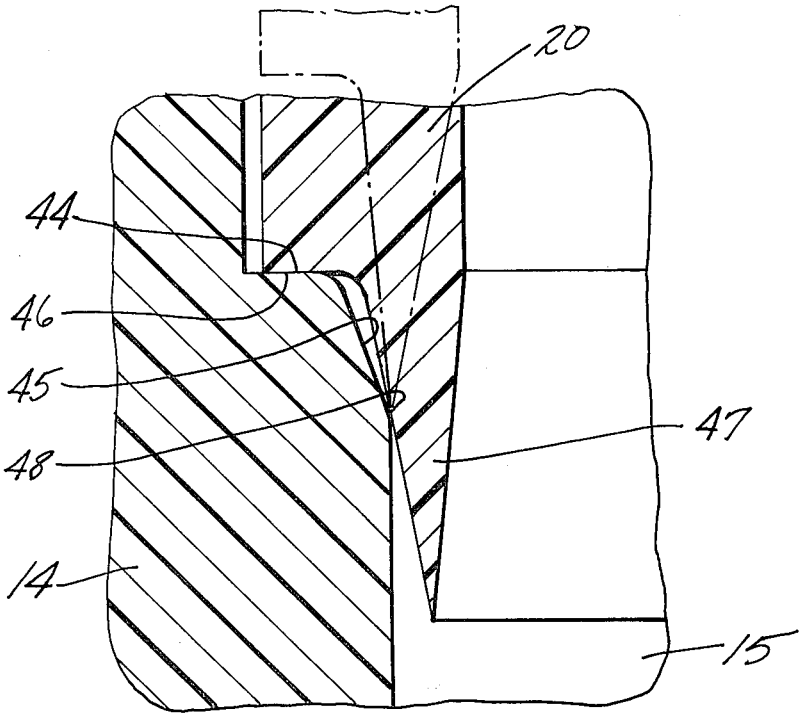

FIG. 8 represents an alternate embodiment wherein tubular projection 14 includes an inwardly extending horizontal ledge 44 which ledge merges with a downwardly extending planar surface 45, the latter merging at a sealing zone 48 with a vertical wall defining mouth opening 15. Bushing 20 includes horizontal sealing shoulder 46 which merges with a downwardly tapered flexible portion 47. As bushing 20 moves downwardly (from the position shown by phantom lines) portion 47 is forced inwardly to produce a seal at sealing zone 48 and a second seal is produced by sealing contact of shoulder 46 and ledge 44.

Figure 9:
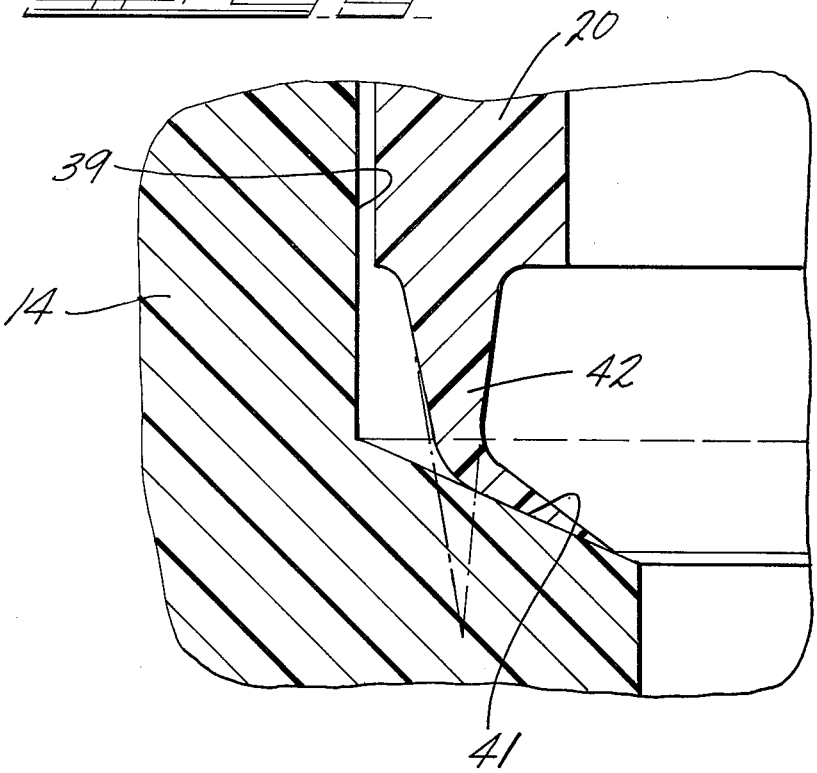

Referring now to FIG. 9 it will be seen that tubular projection 14 includes an inclined downwardly and inwardly extending sealing surface 41. Bushing 20 carries at its lower margin an annular progressively thinning flexible portion 42 which upon tightening of bushing 20 into the tubular projection 14 is forced to bend inwardly and bring about sealing engagement with inclined sealing surface 41. Generally it is preferred that feathered portion 42 when in a free position (generally indicated by the dotted lines) be biased inwardly.

Figure 10:
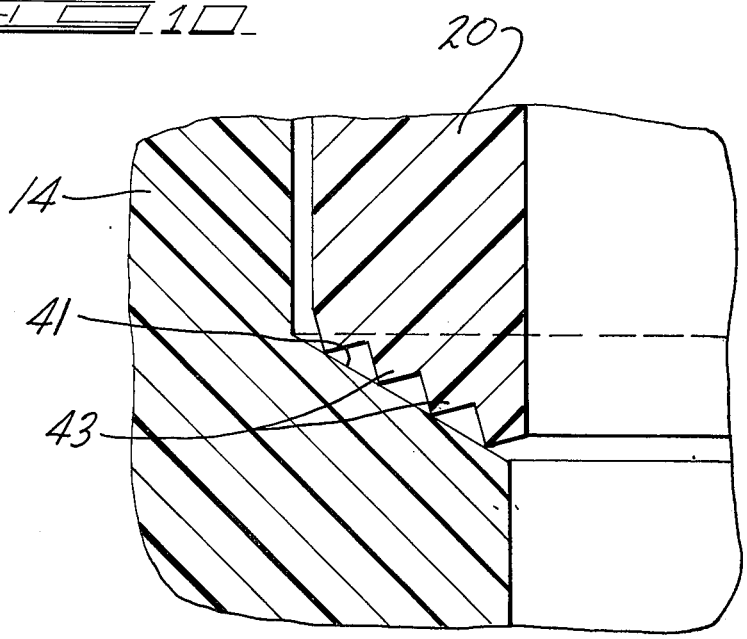

FIG. 10 represents an alternate sealing embodiment in which bushing 20 is provided at its lower margin with flexible denticulated surfaces 43, which are brought into sealing engagement beneath the buttress threads by engagement with inclined sealing surface 41. If desired it will of course be apparent that a bridge member 25 could be employed to join denticulated surfaces 43 to the main body of bushing 20.

One of the outstanding features of the embodiments of FIGS. 6 and 8–10 is that the sealing means of the bushing as formed as a single unit with the bushing and hence, unlike the use of an O-ring, separate inventories are not required.

Preferably in order to obtain the outstanding features of the present invention the plastic bushing will be fabricated by an injection molding process using an appropriate polymer, for example polyethylene. The drum, which is prefabricated preferably by a blow molding operation as a single piece unit, will be formed from high density polyethylene, preferably of ultra high molecular weight. It will be preferred that plug 28 be an injection molded part made for example of polyethylene but for that matter it could be a conventional metal bung plug. Overcap 33 may be of any suitable material such as metal or plastic.

In the foregoing the best mode contemplates employing buttress threads, including modified buttress threads as the thread forms 18 and 23; it desired however other conventional thread forms can be used for threads 18 and 23 so long as the thread form is larger than the pipe thread form 26 of bushing 20.

While various embodiments of the present invention have been described in particularity above it will be of course apparent that modifications are possible which pursuant to the patent statutes and laws do not depart from the present invention.

I claim:

1. A bung hole closure assembly for a plastic drum comprising:

a tubular projection formed on said drum having internal threads and including an annular internal sealing surface, a bushing inserted into said tubular projection having external threads threadably engaging said internal threads of said projection and including internal threads, annular sealing means adjacent said bushing sealingly engaging said sealing surface, releasable interengaging means respectively disposed internally on said tubular projection and externally on said bushing allowing slipping engagement when said bushing is rotated in a tightening direction and locking engagement upon rotation in an opposite direction, said interengaging means being accessible from the exterior of said closure assembly whereby said bushing can be rotated in said opposite direction, said tubular projection and said bushing defining an opening in said drum, said threadably engaged threads of said projection and bushing being of a larger thread form than said internal threads of said bushing.

2. The assembly of claim 1 wherein said annular internal sealing surface is below said internal threads of said projection and said annular sealing means is beneath the external threads of said bushing, thereby isolating said threadably engaged threads of said bushing and said projection.

3. The assembly of claim 2 and further including closure means threadably engaging said bushing internal threads for sealing said opening.

4. The assembly of claim 2 wherein said annular sealing means comprises an O-ring.

5. The assembly of claim 2 wherein said annular sealing means comprises a flexible annular portion formed as a single piece with said bushing at a lower margin thereof.

6. The assembly of claim 5 wherein said flexible annular portion comprises an annular bead-like portion and a thin flexible annular bridge joining said bead-like portion to a main body portion of said bushing.

7. The assembly of claim 6 wherein said sealing surface comprises an upwardly opening annular reentrant portion.

8. The assembly of claim 5 wherein said annular sealing means comprises a denticulated surface.

9. The assembly of claim 5 wherein said annular sealing means comprises an annular progressively downwardly thinning portion.

10. The assembly of claim 2 wherein said interengaging means comprises interacting ratchets and pawls respectively disposed beneath the upper margins of said bushing and tubular projection.

11. The assembly of claim 10 wherein said pawls are integral with said bushing.

12. A bung hole assembly for a plastic drum adapted to receive standard pipe thread fittings comprising:

a tubular projection formed in said drum having internally disposed threads thereon and including an annular internal sealing surface formed below said threads, a bushing disposed internally of said projection, said bushing having externally disposed threads threadably engaging said internally disposed threads of said projection and including inwardly disposed threads adapted to receive said pipe thread fittings, annular sealing means adjacent said bushing beneath said externally disposed threads thereof sealingly engaging said sealing surface and isolating said threadably engaged threads of said bushing and said projection, said internally and externally disposed threads being of a thread form larger than said inwardly disposed threads, and inter-engaging releasable means on said bushing and said projection providing slipping engagement when said bushing is rotated in one direction and a locking engagement when said bushing is rotated in an opposite direction, said inter-engaging means being accessible from the exterior of said closure assembly whereby said bushing can be rotated in said opposite direction.

* * * * *